United States Patent [19]

McCann

[11] Patent Number: 4,935,666

[45] Date of Patent: Jun. 19, 1990

[54] SPARK GAP DEVICES

[75] Inventor: Garry P. McCann, Nettleham Park, United Kingdom

[73] Assignee: English Electric Valve Co., Ltd., Chelmsford, United Kingdom

[21] Appl. No.: 236,884

[22] Filed: Aug. 26, 1988

[30] Foreign Application Priority Data

Aug. 28, 1987 [GB] United Kingdom ..... 8720337
Apr. 22, 1988 [GB] United Kingdom ..... 8809507

[51] Int. Cl.[5] ..... H01J 17/30
[52] U.S. Cl. ..... 313/595; 313/631
[58] Field of Search ..... 313/595, 596, 597, 599, 313/621, 631, 632, 484, 494; 361/120, 129

[56] References Cited

U.S. PATENT DOCUMENTS 3,382,402 5/1968 Lafferty ..... 313/599 X
4,438,365 3/1984 Atkinson ..... 361/129 X
4,631,453 12/1986 de Souza et al. ..... 313/595 X

*Primary Examiner*—Sandra L. O'Shea
*Attorney, Agent, or Firm*—Spencer & Frank

[57] ABSTRACT

A spark gap device includes planar electrodes between which in operation a discharge occurs. The electrodes are spaced apart by a ceramic member and are arranged in substantially parallel, different, planes. A trigger electrode is included for switching the device into conduction. The device has a low inductance structure which is compatible with stripline circuits. In another embodiment of the invention the planar electrodes and the trigger electrode are located in the same plane on a common substrate.

18 Claims, 3 Drawing Sheets

SPARK GAP DEVICES

FIELD OF THE INVENTION

This invention relates to spark gap devices and more particularly, but not exclusively, to a spark gap device for use in stripline circuits.

BACKGROUND OF THE INVENTION

A spark gap device is one in which a discharge occurs between two electrodes. The device may be used as a switch, in which case a trigger electrode is included and the discharge is triggered by applying a suitable potential to it. A spark-gap device may alternatively be of the over-voltage type, in which breakdown occurs when a threshold potential difference between the two electrodes is exceeded. In presently known spark gap devices, the electrodes are rod-like and contained within a cylindrical envelope.

SUMMARY OF THE INVENTION

The present invention seeks to provide an improved spark gap device.

According to the invention, there is provided a spark gap device comprising planar electrodes between which, in operation, a discharge occurs. The planar electrodes are most conveniently flat but they could be curved for example. It is preferred that the planar electrodes are located in different planes, part of one electrode overlapping part of the other, the discharge occurring between the two parts. The degree of overlap determines the amount of current which a spark gap device is capable of passing. Typically, a current of several thousand amperes can flow between the two electrodes. Such a spark gap device presents a low inductance because of its configuration, thereby enabling fast switching speeds to be achieved compared to those generally possible using a conventional device. A typical value of the inductance of a device in accordance with the invention may be in the region of nanohenries, whereas that of a conventional spark gap used for similar applications would have an inductance of some microhenries. Thus, the current rise time is small and there are very low arc losses. Another significant advantage of a spark gap device in accordance with the invention is that it may be made compatible with stripline circuits, the electrodes being an extension of conductors included in the circuit. The width of the electrodes is chosen according to the application in which the device is used. A spark gap device in accordance with the invention may be made extremely compact in one dimension by enclosing the electrodes within a planar envelope. It may also be made particularly robust, being highly shock-resistant and able to withstand greater vibration than a conventional device. The device can also be surface-mountable, which may be particularly advantageous in some applications. Another advantage of a device in accordance with the invention is that it can be cheap to fabricate.

The gap between the electrodes may be hermetically sealed and the medium between the electrodes may be a vacuum, or a suitable gas or liquid. By suitably choosing the pressure of gas within the device, its characteristics can be changed without modifying its physical configuration.

It is preferred that electrically insulating material is included in the device, being located between the electrodes. The insulating material can be used to locate the electrodes, which may, for example, be brazed to the insulating material. In a preferred embodiment of the invention, the insulating material is absent from a cylindrical region where the discharge is arranged to occur, that is, the overlapping parts of the electrodes are circular.

It is preferred that a trigger electrode is included and is located between the overlapping parts of the planar electrodes. In a particularly advantageous configuration of the trigger electrode, it comprises a projecting portion arranged between the overlapping parts of the planar electrodes and a planar portion. As the device is of low inductance, it has very fast switching speeds and the current pulse it passes when in the conducting mode has a very fast rise time, providing low arc losses. It is preferred that insulating material is located between the planar portion of the trigger electrode and a planar electrode, and that preferably the planar portion of the trigger electrode and the planar electrode are located in respective different, substantially parallel, planes. A device in accordance with the invention may thus have a low profile and occupies a small volume.

Advantageously, a protective coating may be included to encapsulate the device, thus preventing or reducing the tendency for external breakdown to occur.

In an alternative embodiment of the invention, the planar electrodes are located in substantially the same plane, and advantageously are located on a substrate of insulating material. It may be advantageous to arrange that the parts of the electrodes between which the discharge occurs are contained within electrically insulating material.

A trigger electrode may be included or the device may be of the over-voltage type. Where a trigger electrode is included, preferably it is also planar. The trigger electrode and one of the electrodes between which the main arc occurs may be made in such a shape that the distance between the electrodes is maintained substantially constant throughout the operating life of the device as erosion is arranged to occur at an edge of the electrode other than that facing the other main electrode.

In one embodiment of the invention, the spark gap device is constructed and arranged to act as a light source. Each time the discharge is struck across the electrodes, light may be produced which may be sufficiently bright to be used, for example, for stroboscopic purposes. Preferably, at least some insulating material which surrounds the electrodes is transparent to the light but, for example, an optical fibre might be introduced into the space between the electrodes to conduct light from the device.

BRIEF DESCRIPTION OF THE DRAWINGS

Some ways in which the invention may be performed are now described by way of example with reference to the accompanying drawings in which.

DESCRIPTION OF THE PREFERRED EMBODIMENTS

Figure 1:
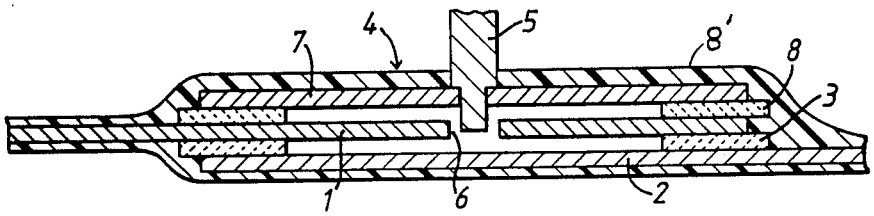
FIG. 1 is a sectional view of a spark gap device in accordance with the invention.
Figure 2:
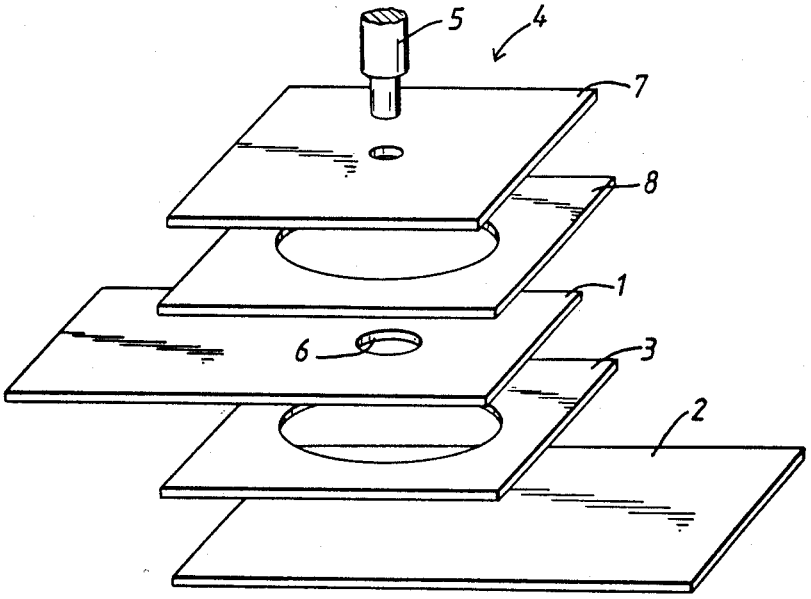
FIG. 2 is an exploded, perspective view of the device shown in FIG. 1.

With reference to FIGS. 1 and 2, a spark gap device in accordance with the invention comprises two planar electrodes 1 and 2, the first electrode 1 being connected to act as a cathode and the other electrode 2 as an anode. The electrodes 1 and 2 are arranged substantially parallel to one another, there being some overlap between them. A ceramic member 3 spaces the electrodes 1 and 2 apart and is brazed to them. The ceramic member 3 includes a circular central aperture which defines the overlapping areas of the two electrodes 1 and 2 between which, in operation, a discharge may occur.

As the spark gap device is intended to act as a switch in a stripline circuit, it includes a trigger electrode indicated generally at 4. The trigger electrode comprises a cylindrical portion 5 which is arranged to project through an aperture 6 in the cathode electrode 1, and a planar portion 7. The planar portion 7 is arranged substantially parallel to the electrodes 1 and 2, being spaced from the cathode electrode 1 by a ceramic member 8 which is similar to the ceramic member 3 between the electrodes 1 and 2. The gap between the electrodes 1 and 2 is hermetically sealed and the pressure of the air within the device is chosen to provide desired operational characteristics. The whole device is encapsulated by a protective layer 8, (not shown in FIG. 2).

The device is able to hold off voltages of about 10 kV and when it is wished to switch the device into conduction, a trigger pulse is required which is typically of the order of 5 kV, the trigger pulse being usually derived from a trigger transformer.

Figure 3:
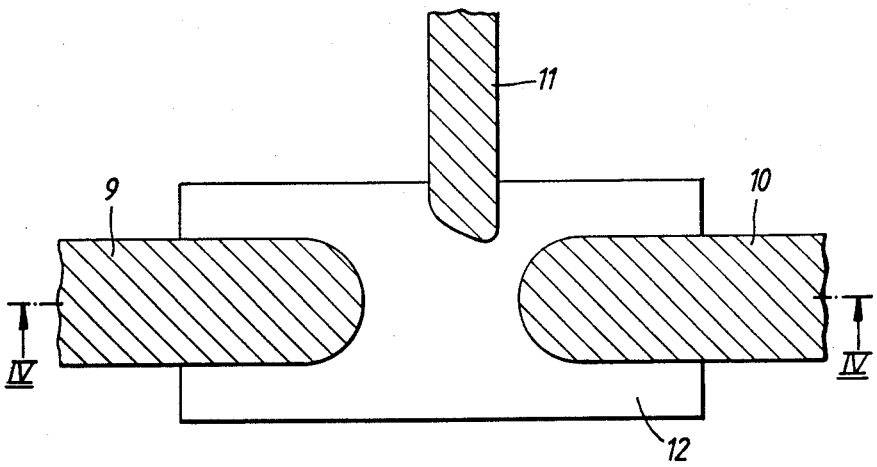
FIG. 3 is a sectional view of another spark gap device in accordance with the invention.
Figure 4:
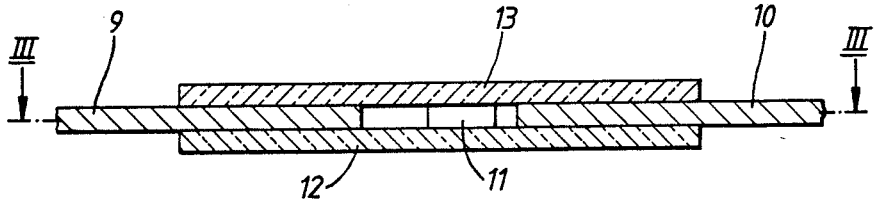
FIG. 4 is a view along line IV—IV of FIG. 3.

With reference to FIGS. 3 and 4, another spark gap device in accordance with the invention comprises two planar electrodes 9 and 10 between which, in operation, breakdown occurs. A planar trigger electrode 11 is located between the two planar electrodes 9 and 10 and is used to initiate a discharge when required. The conductors 9 and 10 and trigger electrode 11 are of thin copper strip about 0.5mm thick. The conductors 9 and 10 are about 2.5 cm wide and the trigger electrode is about 0.75 cm wide. The electrodes could be of another suitable conducting material or a composite material, for example. The conductors 9 and 10 and the trigger electrode 11 are contained between two insulating members 12 and 13 which are hermetically sealed to the copper conductors. The medium between the conductors and the trigger electrode is air and in this embodiment the insulating members 12 and 13 are of epoxy glass but they could be, for example, of ceramic.

During operation of the device, the hold-off voltage between the two conductors 9 and 10 is in the region of 1 to 10 kV and to initiate breakdown between the conductors 9 and 10, a trigger voltage of 1 to 2 kV is applied to the trigger electrode 11.

Figure 5:
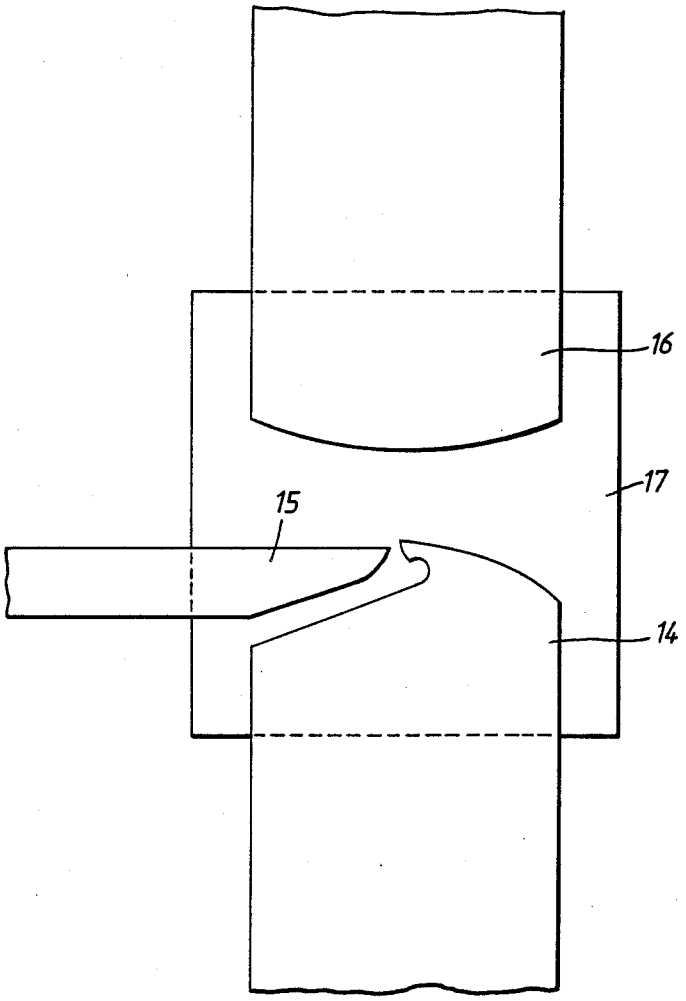
FIG. 5 is a sectional view of another spark gap device in accordance with the invention.

With reference to FIG. 5, in another spark gap device in accordance with the invention, one of the electrodes 14 and the adjacent trigger electrode 15 are shaped such that when the triggering arc is struck between them, the electrode 14 tends to be eroded behind that edge which faces the other main electrode 16. Thus the distance between the two electrodes 14 and 16 remains substantially constant over a relatively long operating time. In this device, the insulating envelope, part of which 17 is shown, is transparent to light generated during operation of the device, enabling it to be used as a light source if desired.

I claim:

1. A planar spark gap device comprising first and second planar electrodes located in different substantially parallel planes, a part of said first electrode overlapping a part of said second electrode;

electrically insulating material interposed between said first and second electrodes; and a trigger electrode positioned between the overlapping parts of said first and second planar electrodes, a discharge being initiated between the overlapping parts of said first and second planar electrodes when a trigger voltage is applied to said trigger electrode.

2. A spark discharge device as claimed in claim 1 wherein at least a portion of said insulating material is transparent, light emitted by said discharge being transmitted through the transparent portion of said insulating material.

3. A spark gap device as claimed in claim 1 wherein said discharge occurs in a cylindrical volume defined by said electrically insulating material.

4. A spark gap device as claimed in claim 1 wherein said electrically insulating material is ceramic, and wherein said first and second electrodes are brazed thereto.

5. A spark gap device as claimed in claim 1 wherein said trigger electrode comprises a planar portion and a projecting portion, the projecting portion of said trigger electrode being positioned between the overlapping parts of said first and second electrodes.

6. A spark gap device as claimed in claim 5 which further includes insulating material located between the planar portion of said trigger electrode and one of said first and second planar electrodes.

7. A spark gap device as claimed in claim 5 wherein the planar portion of said trigger electrode and said first and second planar electrodes are located in respective different, substantially parallel, planes.

8. A spark gap device as claimed in claim 1 which further includes a protective coating surrounding said first and second electrodes.

9. A planar spark gap device comprising first and second spaced substantially coplanar electrodes; and a trigger electrode positioned between said first and second electrodes, a discharge being initiated between said first and second electrodes when a trigger voltage is applied to said trigger electrode.

10. A spark gap device as claimed in claim 9 wherein said substantially coplanar electrodes are located on a substrate of electrically insulating material.

11. A spark gap device as claimed in claim 10 wherein the parts of said electrodes between which said discharge occurs are contained within insulating material.

12. A spark discharge device as claimed in claim 11 wherein at least a portion of said insulating material is transparent, light emitted by said discharge being transmitted through the transparent portion of said insulating material.

13. A spark gap device as claimed in claim 9 wherein said trigger electrode is planar and located in the same plane as said first and second electrodes.

14. A spark gap device as claimed in claim 9 wherein said first and second electrodes have opposing edges, and wherein said trigger electrode is arranged adjacent said first planar electrode, said trigger electrode and said first planar electrode having configurations such that erosion due to discharges between them tends to occur at a part of said first electrode other than that facing said second planar electrode.

15. A spark gap device as claimed in claim 14 wherein said first planar electrode includes a part which projects from the main body of said electrode.

16. A spark gap device as claimed in claim 9 wherein the space between said first and second electrodes is hermetically sealed.

17. In combination with a stripline circuit, a planar spark gap device comprising first and second planar electrodes located in different substantially parallel planes, a part of said first electrode overlapping a part of said second electrode;

electrically insulating material interposed between said first and second electrodes; and a trigger electrode positioned between the overlapping parts of said first and second planar electrodes, a discharge being initiated between the overlapping parts of said first and second planar electrodes when a trigger voltage is applied to said trigger electrode.

18. In combination with a stripline circuit, a planar spark gap device comprising first and second spaced substantially coplanar electrodes; and a trigger electrode positioned between said first and second electrodes, a discharge being initiated between said first and second electrodes when a trigger voltage is applied to said trigger electrode.

* * * * *